US006823856B2

(12) United States Patent
Rager

(10) Patent No.: US 6,823,856 B2
(45) Date of Patent: Nov. 30, 2004

(54) VERTICAL DROP ARROW REST

(76) Inventor: Christopher A. Rager, 970 Doane Rd., Bozeman, MT (US) 59718

( * ) Notice: Subject to any disclaimer, the term of this patent is extended or adjusted under 35 U.S.C. 154(b) by 0 days.

(21) Appl. No.: 10/656,994

(22) Filed: Sep. 5, 2003

(65) Prior Publication Data

US 2004/0112357 A1 Jun. 17, 2004

Related U.S. Application Data

(60) Provisional application No. 60/410,723, filed on Sep. 13, 2002, and provisional application No. 60/410,877, filed on Sep. 13, 2002.

(51) Int. Cl.[7] ..... F41B 5/22
(52) U.S. Cl. ..... 124/44.5
(58) Field of Search ..... 124/24.1, 44.5

(56) References Cited

U.S. PATENT DOCUMENTS

| | | | | |
|---|---|---|---|---|
| 4,071,014 A | | 1/1978 | Trotter | |
| 4,453,528 A | * | 6/1984 | Eckert | 124/44.5 |
| 4,796,597 A | | 1/1989 | Farro | |
| 4,803,971 A | | 2/1989 | Fletcher | |
| 4,809,669 A | | 3/1989 | Saunders | |
| 4,809,670 A | | 3/1989 | Simo | |
| 4,838,237 A | | 6/1989 | Cliburn | |
| 4,865,007 A | | 9/1989 | Saunders | |
| 4,881,515 A | | 11/1989 | Simo | |
| 4,898,145 A | | 2/1990 | Simo | |
| 4,899,716 A | | 2/1990 | Martin et al. | |
| 4,907,566 A | * | 3/1990 | Klein | 124/44.5 |
| 4,947,823 A | | 8/1990 | Larson | |
| 4,953,521 A | * | 9/1990 | Troncoso et al. | 124/24.1 |
| 5,009,215 A | | 4/1991 | Ludwig | |
| 5,052,364 A | | 10/1991 | Martin et al. | |
| 5,062,407 A | | 11/1991 | Newbold | |
| 5,065,731 A | | 11/1991 | Smith | |
| 5,070,855 A | | 12/1991 | Troncoso | |
| 5,081,980 A | | 1/1992 | Newbold | |
| 5,085,201 A | | 2/1992 | Tepper et al. | |
| 5,095,884 A | | 3/1992 | Mertens | |
| 5,103,797 A | | 4/1992 | Newbold | |
| 5,117,803 A | | 6/1992 | Johnson | |
| 5,137,006 A | | 8/1992 | Gallops | |
| 5,150,700 A | * | 9/1992 | Troncoso | 124/44.5 |
| 5,161,514 A | | 11/1992 | Cary | |
| 5,213,090 A | | 5/1993 | Tone | |
| 5,285,764 A | | 2/1994 | Mertens | |
| 5,325,839 A | | 7/1994 | Scheffer | |
| 5,365,912 A | | 11/1994 | Pittman | |
| 5,383,441 A | | 1/1995 | Lightcap, Jr. | |
| 5,385,135 A | | 1/1995 | Saunders | |
| 5,386,814 A | | 2/1995 | Denton | |
| 5,400,763 A | | 3/1995 | Mazza | |
| 5,415,154 A | | 5/1995 | Angeloni | |
| 5,460,152 A | | 10/1995 | Specht | |
| 5,490,492 A | | 2/1996 | Savage | |
| 5,503,136 A | | 4/1996 | Tone | |
| 5,533,494 A | | 7/1996 | Sacco | |
| 5,592,930 A | | 1/1997 | Roberts et al. | |

(List continued on next page.)

*Primary Examiner*—John A. Ricci
(74) *Attorney, Agent, or Firm*—Merchant & Gould P.C.

(57) ABSTRACT

A drop-away arrow rest having an arrow support arm that drops in a straight, non-pivotal and non-rotational path. The arrow rest has an arrow support arm that lifts the arrow from a first, relaxed, position to a second, actuated, position when the archer draws the bowstring. Upon release of the bowstring, the arrow support arm drops, with vertical, non-rotational and non-pivotal movement, in a straight line, to return to its relaxed state. Actuation and release of the arrow support arm is accomplished by an attachment to the bowstring, such as a cord, and by a biasing spring. The arrow rest includes various adjustments that allow lateral and/or horizontal positioning of the arrow in relation to the bow handle.

20 Claims, 4 Drawing Sheets

U.S. PATENT DOCUMENTS 5,601,069 A 2/1997 Clark
5,606,961 A 3/1997 Basik et al.
5,632,263 A * 5/1997 Sartain ..... 124/44.5
5,673,678 A 10/1997 Savage
5,722,381 A 3/1998 Mizek
5,915,369 A 6/1999 Sheliga
5,960,779 A 10/1999 Jessee et al.
6,021,769 A 2/2000 Troncoso
6,044,832 A 4/2000 Piersons, Jr.
6,050,251 A 4/2000 Harwath et al.
6,089,216 A 7/2000 Harwath et al.
6,142,134 A 11/2000 Meeks
6,178,959 B1 1/2001 Troncoso, Jr. et al.
6,363,924 B1 4/2002 Adams, Jr.
6,561,174 B1 5/2003 Afshari
6,595,195 B1 7/2003 Barner et al.

* cited by examiner

VERTICAL DROP ARROW REST

CROSS REFERENCE TO RELATED APPLICATION

This application claims priority under 35 U.S.C. § 119(e) to U.S. provisional application Ser. No. 60/410,723, filed Sep. 13, 2002 and entitled "Arrow Rest". The entire disclosure of 60/410,723 is incorporated by reference and claim benefit of 60/410,877 filed Sep. 13, 2002.

FIELD OF THE INVENTION

This invention is directed to an arrow rest for use with an archery bow. In particular, the arrow rest has a linear, or straight drop, arrow support arm.

BACKGROUND OF THE INVENTION

In the sport of archery, there are many accessories used in conjunction with the bow in order to obtain a more accurate shot. An example of a common accessory is an arrow rest. Arrow rests are used to lift the arrow off from the shelf of the bow handle, to support the arrow when the bowstring is drawn, and to release the arrow after the bowstring has been released. An object of an arrow rest is to allow the arrow to fly straight after being released.

As with other accessories, such as sights, there are numerous different designs for arrow rests. One general design of arrow rests is a "drop-away arrow rest", which has a support structure that supports the arrow while the archer is at full draw and then rotates out of the way as the archer releases the arrow. Drop-away arrow rests that rotate out of the way are shown, for example, in U.S. Pat. Nos. 4,803,971; 4,865,007; 5,415,154; 5,960,779, and 6,044,832.

However, improvements are needed. One issue with many drop-away arrow rests is that the bow support arm does not drop away from the arrow sufficiently fast, thus hindering the flight of the arrow. Another issue is that many spring-loaded or pivotal arrow rests have recoil remaining after the arrow is released, causing the arrow support to move back into the path of the arrow. Attempts have been made to compensate for this recoil and to design a faster acting drop, however, the results have been marginal.

What is needed is an arrow rest that falls away quickly and does not hinder the flight of the arrow.

SUMMARY OF THE INVENTION

The invention is directed to a drop-away arrow rest having an arrow support member or arm that drops in a linear or straight path. When the archer releases the arrow, the support arm falls or is pulled away in a straight path rather than a rotating, pivoting, or swooping path. In preferred embodiments, the arrow support drops vertically in a straight path.

In one aspect, the invention is to an arrow rest that has an arrow support arm that lifts the arrow, from a first position to a second position, in a straight path while the archer draws the bow. The arrow support arm drops in a straight path when the archer releases the arrow. The arrow support arm is movable in a straight line, preferably vertically, between its first position and its second position.

The arrow support arm is operably connected to and synchronized with the bowstring of the bow. When the arrow is at rest and the bowstring is not drawn, the arrow support arm is in a relaxed state. When the bowstring is drawn, the arrow support arm is in an actuated state with the support arm supporting the arrow. Upon release of the bowstring, the arrow support arm drops, with vertical, non-rotational and non-pivotal movement, in a straight line, to return to its relaxed state. The retracted arrow support arm does not interfere with the arrow or its fletching as the arrow is released.

The arrow rest includes an adjustment means that allows lateral or horizontal positioning of the arrow support arm in relation to the bow handle. The arrow rest also includes an adjustment means that allows vertical positioning of the arrow support arm in relation to the handle.

The arrow rest may include a vibration dampening system incorporated therein.

In one particular embodiment, the invention is directed to an arrow rest comprising a support structure configured for mounting on a bow handle, an arrow support arm operably connected to the support structure, the arrow support arm movable in relation to the support structure from a relaxed position to an actuated position in a non-pivotal, non-rotational manner, a connection means such as a cord for operably connecting the arrow support arm to the bowstring and for moving the arrow support arm from the relaxed position to the actuated position, and a biasing means such as a spring for moving the arrow support arm from the actuated position to the relaxed position.

In another particular embodiment, the invention is directed to an arrow rest comprising a support structure for mounting on the bow handle, the support structure comprising a first structure, a second structure, and a third structure, with the third structure laterally and vertically movable in relation to the first structure, an arrow support arm movable from a relaxed position to an actuated position in a non-pivotal, non-rotational path of motion, and an actuation system operably connecting the arrow support arm to the bowstring for moving the arrow support arm between the relaxed position and the actuated position.

The actuation system can include a biasing means, such as a spring, and a connection means, such as a cord for connection to the bowstring. The biasing means moves the arrow support arm from the actuated position to the relaxed position and the connection means moves the arrow support arm from the relaxed position to the actuated position.

In yet another particular embodiment, the invention is directed to an arrow rest comprising a first support structure, a second support structure, and a third support structure, the third support structure laterally and vertically movable in relation to the first support structure, a guide rod centrally positioned in a coiled spring and connected to the third support structure, an arrow support arm movably connected to the third support structure from a relaxed position to an actuated position along the guide rod, and an actuation system for moving the arrow support arm between the relaxed position and the actuated position. The actuation system can include the coiled spring, which moves the arrow support arm from the actuated position to the relaxed position. Additionally, the actuation system can include a connection means, such as a cord connecting the arrow support arm to the bowstring, to move the arrow support arm from the relaxed position to the actuated position.

DETAILED DESCRIPTION OF THE PREFERRED EMBODIMENT

In the following description of preferred embodiment, reference is made to the accompanying drawings, which form a part hereof, and in which is shown, by way of illustration, specific embodiments in which the invention may be practiced. It is to be understood that other embodiments may be utilized and structural changes may be made without departing from the scope of the present invention.

Figure 1:
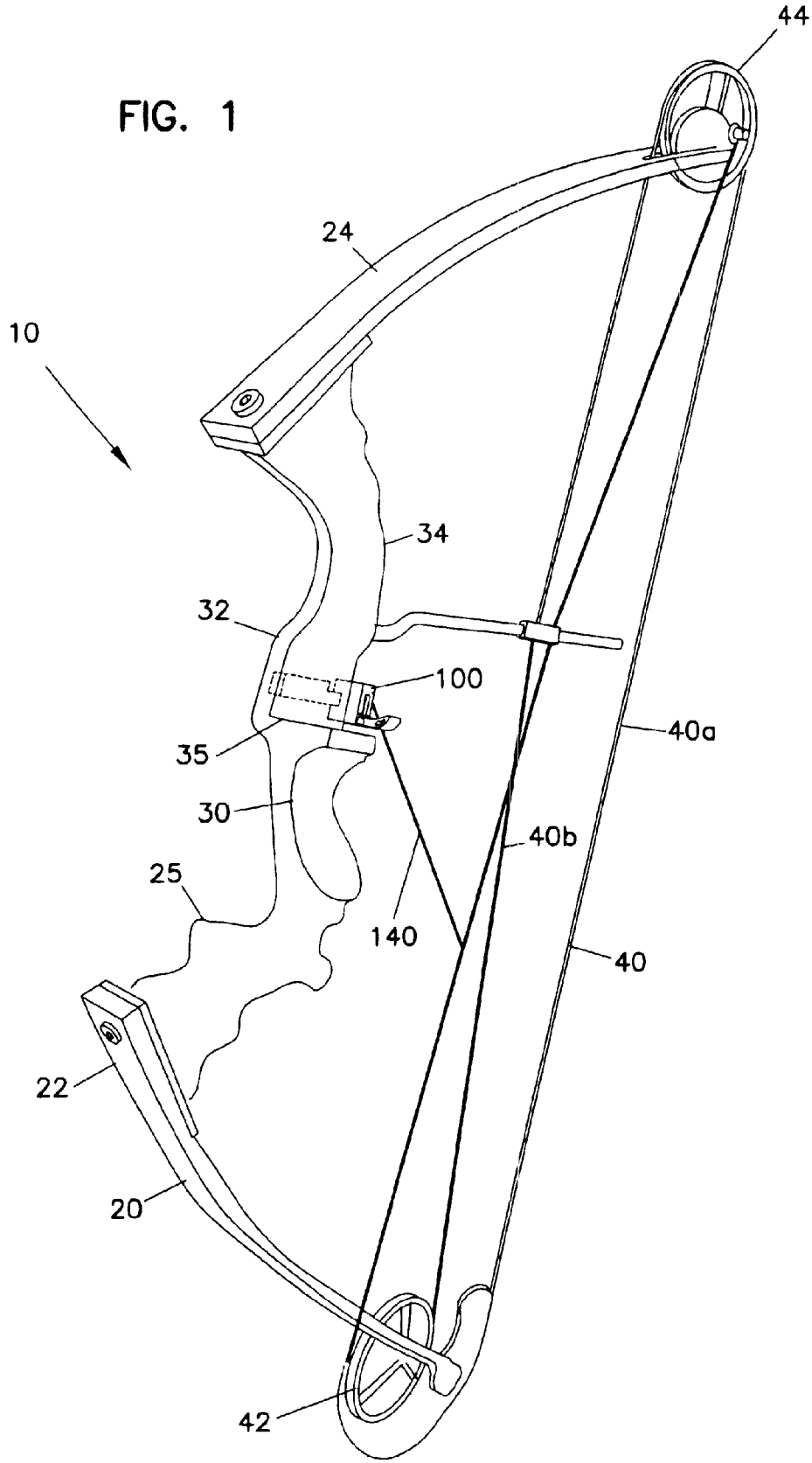
FIG. 1 is a perspective view of a bow incorporating an arrow rest.

Referring now to the figures, wherein like features are referenced with like numerals, a bow 10 is shown in FIG. 1. Bow 10 has a frame 20 and a string 30. Frame 20 includes a lower portion or arm 22, an upper portion or arm 24, and a handle portion 25 with a grip 30 connected to and supporting lower arm 22 and upper arm 24. Handle 25 has a front surface 32 and an opposite back surface 34. During shooting with the bow, front surface 32 is positioned facing the target and back surface 34 is facing the archer. Present above grip 30 is a ledge 35.

Bow 10 is illustrated as a compound bow, with pulley or cam 42 at the end of lower arm 22 and pulley or cam 44 at the end of upper arm 24. A bowstring 40 extends between cam 42 and cam 44. Cams 42, 44 provide a mechanical advantage to the archer when drawing bowstring 40. Bowstring 40 includes at least two sections 40*a*, 40*b* extending between cams 42, 44; bowstring section 40*a* is the section on which a bow is seated. On some bows, bowstring section 40*b* is a cable. Although not illustrated, a peep sight may be positioned on bowstring 40 to facilitate targeting and aiming. Also not illustrated, a sight may be attached to handle 25 to facilitate targeting and aiming. Mounted on handle 25 of bow 10 is an arrow rest 100, which provides a support structure to hold the arrow while the archer is in the shooting position, just prior to releasing the arrow.

Figure 3:
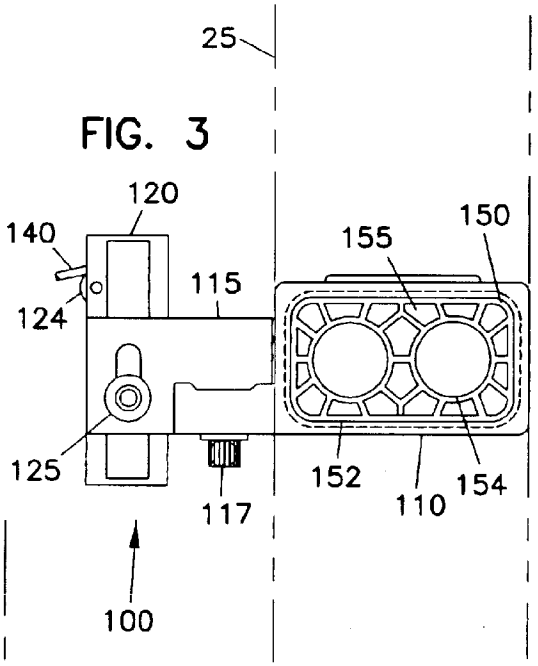
FIG. 3 is a left side view of the arrow rest of the invention similar to that shown in FIG. 2.
Figure 4B:
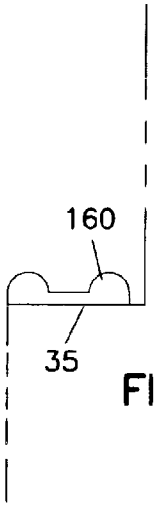
FIG. 4B is a front view of an arrow rack, used in conjunction with the arrow rest.
Figure 4A:
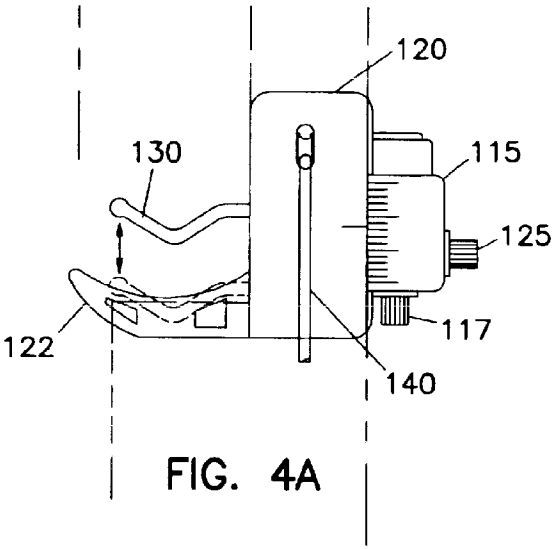
FIG. 4A is a front view of the arrow rest of the invention positioned on a bow.

Referring to FIGS. 2, 3, 4A and 5, a preferred embodiment of an arrow rest is illustrated as arrow rest 100. For purposes of this application, the view of the arrow rest as seen from the archer in the shooting position, which is the view illustrated in FIG. 4A, is referred to as the "front view" of the arrow rest. When the arrow rest is mounted on a bow and held in a shooting position, the axis of the arrow rest horizontal to the ground, in the plane of the front view, and perpendicular to any arrow retained by the arrow rest, is considered "lateral". The axis of the arrow rest, perpendicular to the ground, is considered "vertical". When arrow rest 100 is properly mounted on handle 25 and bow 10 is properly held, the lateral axis will be generally horizontal.

Figure 2:
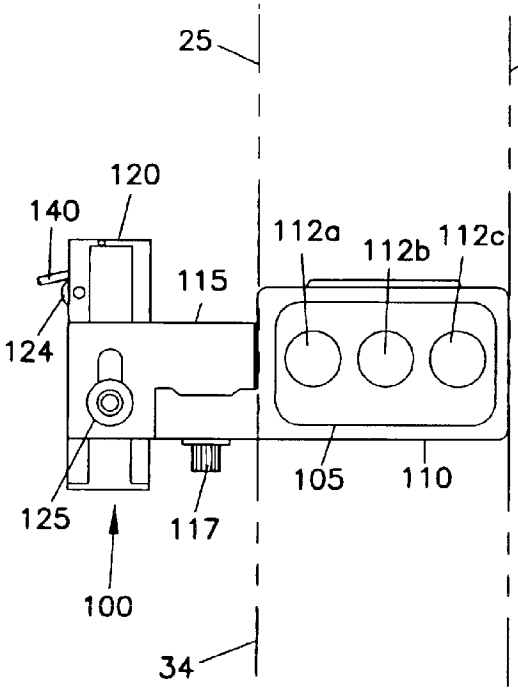
FIG. 2 is a partially exploded left side view of an arrow rest of the invention positioned on a bow.
Figure 5:
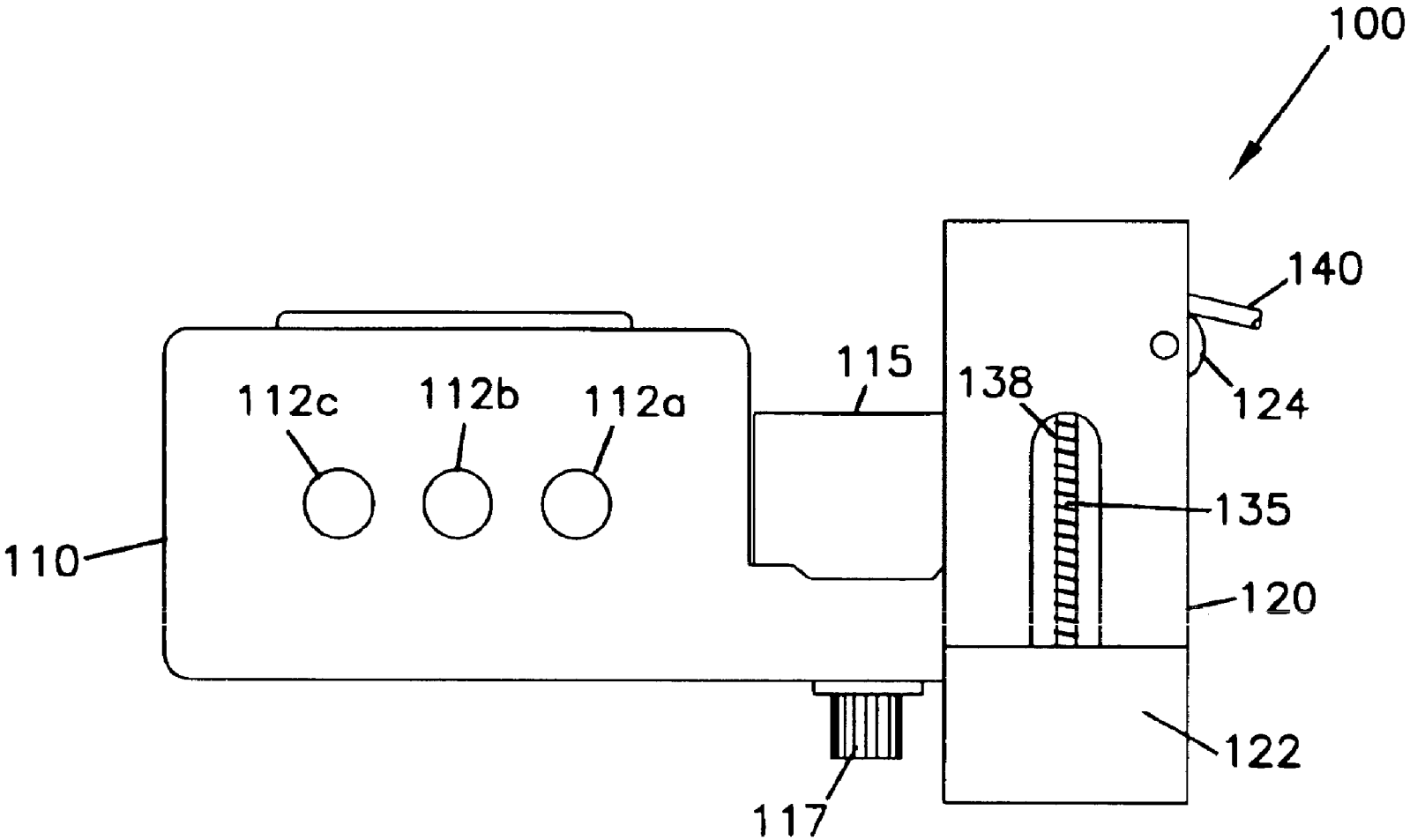
FIG. 5 is a right side view of the arrow rest of the invention.

Arrow rest 100 includes a support structure 110 for mounting arrow rest 100 to bow handle 25, typically above ledge 35 and often supported by ledge 35. As best seen in FIGS. 2 and 5 support structure 110 includes three mounting holes 112*a*, 112*b*, 112*c* for attaching arrow rest 100 to handle 25 with screws or other attachment means. It is understood that not all three mounting holes 112*a*, 112*b*, 112*c* need to be utilized to hold arrow rest 100 to handle 25.

Arrow rest 100 also includes a bracket 115, a front arrow support 120, and an arrow support arm 130. In this embodiment, bracket 115 connects to and supports front arrow support 120 in relation to support structure 110 and bow handle 25. To front arrow support 120 is movably connected arrow support arm 130. Arrow support arm 130 is vertically, non-pivotally and non-rotationally movable from a first location to a second location, as will be described below.

Returning to support structure 110 and bracket 115, bracket 115 is adjustable in relation to support structure 110; particularly, bracket 115 is laterally adjustable in relation to support structure 110. Lateral adjustment of bracket 115 results in lateral or horizontal adjustment of support structure 110, which contacts bow handle 25, in relation to front arrow support 120. That is, adjustment of bracket 115 adjusts the placement of front arrow support 120 relative to support structure 110 and bow handle 25. Either or both of bracket 115 and support structure 110 can have a dovetail arrangement to allow for adjustment. An adjustment mechanism 117 is provided to facilitate adjustment of bracket 115. The adjustment can be stepped or otherwise incremental, or can be continuous. One or both of bracket 115 and support structure 110 can include indicia to indicate the relative position of bracket 115 in relation to structure 110.

As stated, connected to bracket 115 is front arrow support 120. Front arrow support 120 includes receiver 122. Receiver 122 is shaped and sized to correspond to, and preferably accept, arrow support arm 130. In a preferred embodiment, receiver 122 has a structure that allows arrow support arm 130 to at least partially fall below the top surface of receiver 122. For example, receiver 122 may include a recess or groove into which arrow support arm 130 can recede. See, for example, FIG. 4A, which shows arrow support 130 (in phantom) partially recessed into receiver 122. Additional discussion regarding arrow support arm 130 is provided below.

Front arrow support 120 is adjustable in relation to bracket 115, particularly, front arrow support 120 is vertically adjustable in relation to bracket 115. Vertical adjustment of front arrow support 120 results in adjusting the height of receiver 122 and arrow support arm 130 in relation to bow handle 25. Either or both of front arrow support 120 and bracket 115 can have a dovetail arrangement to allow for adjustment. An adjustment mechanism 125 is provided to facilitate adjustment of front arrow support 120 in relation to bracket 115. The adjustment can be stepped or incremental, or can be continuous. One or both of bracket 115 and front arrow support 120 can include indicia to indicate the relative position of front arrow support 120 in relation to bracket 115.

The lateral and vertical positioning of bracket 115 and front arrow support 120, respectively, are preferably optimized for aiming and shooting an arrow supported on arrow support arm 130. It is understood that arrow rest 100, rather than having each of the three pieces described, i.e., support structure 110, bracket 115 and front arrow support 120, arrow rest 100 could have only two pieces, or even be a single piece. The three pieces described are preferred in order to best position arrow support arm 130.

Arrow support arm 130 supports and retains an arrow thereon prior to the archer releasing the bowstring. In a preferred embodiment, arrow support arm 130 protrudes generally horizontally from front arrow support structure 120, as seen by the archer at full draw and in FIG. 4A. Arrow support arm 130 may include a bend or other feature to cradle or better center an arrow thereon. This feature could be V-shaped, U-shaped, square, rounded, be two or more vertical posts, be bristles, or the like.

Arrow support arm 130 is movably connected to support structure 120. Specifically, arrow support arm 130 is vertically movable in relation to support structure 120 from a first position to a second position. In the preferred embodiment described, arrow support arm 130, when in the first position, is in a "relaxed" state, and, when in the second position, is in an "actuated" state, supporting an arrow. Typically, when the archer is in full draw, the arrow support arm 130 is in the actuated state. Referring to FIG. 4A, arrow support arm 130 is shown in its actuated state, ready to support an arrow; the arrow support arm is movable to its relaxed state, shown in phantom in FIG. 4A. The relaxed position is usually below the typical line of fire of the arrow. An actuation system moves arrow support arm 130 between the relaxed stated and the actuated state.

The actuation system, which causes movement of support arm 130, includes a connection means, such as cord 140, and a biasing means. Cord 140 operationally connects arrow support arm 130 to bowstring 40, so that when the archer draws bowstring 40 in preparation of shooting, cord 140 moves arrow support arm 130 from its relaxed state to its actuated state. When bowstring 40 is released, cord 140 releases and arrow support arm 130 moves to its relaxed state, due to urging by the biasing means. Arrow rest 100 includes a pulley 124 to facilitate movement of cord 140.

Alternatives to cord 140 could be strings, wires, rubber bands, hydraulics, magnets, a solid linkage attached to bowstring 40, or any other structure or combination that operably connects arrow support arm 130 to bowstring 40 and that will change the position of support arm 130 when the position of bowstring 40 is changed.

Figure 6:
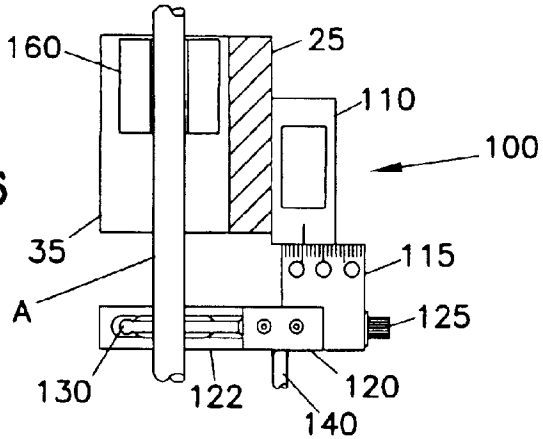
FIG. 6 is a top view of the arrow rest of the invention.
Figures 7A, 7B, 7C, 7D, 7E, 7F, 7G:
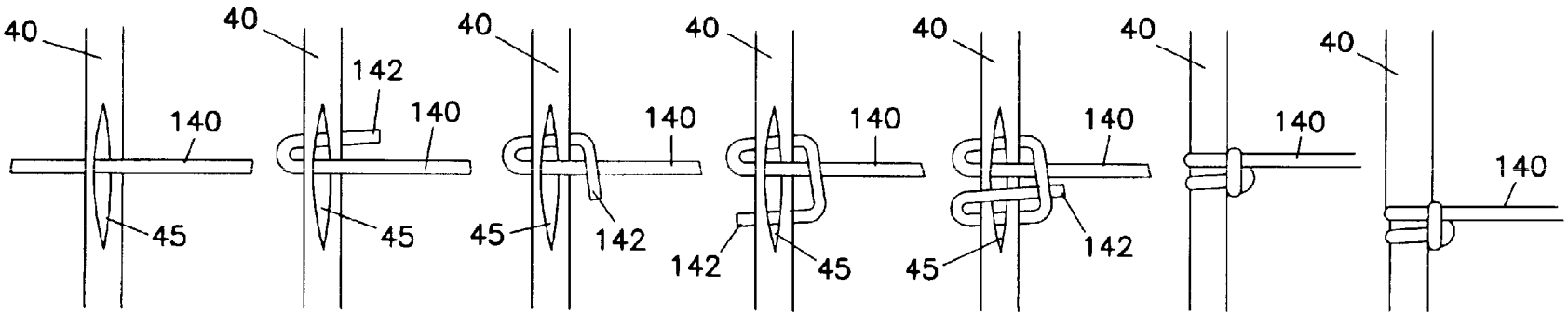
FIGS. 7A through 7G illustrate a procedure for securing a string from the arrow rest to a bowstring.

Referring to FIGS. 7A through 6G, a preferred method for attaching cord 140 to bowstring 40 is schematically illustrated. Cord 140 extends from front arrow support 120 and has an end 142 opposite arrow support 120 that is end 142 is the free end cord 140. In FIG. 7A, end 142 of cord 140 is passed through a slot 45 made in bowstring 40. End 142 is brought back around bowstring 40 and crossed over cord 140, as illustrated in FIGS. 7B and 7C. End 142 is then brought back around bowstring 40 on the same side (FIG. 7D) and tucked under the resulting loop in FIG. 7E. In FIG. 7F, the resulting knot is tightened, and in FIG. 7G the knot is lowered to its desired position. The position of the knot on bowstring 40 affects the distance arrow support arm 130 moves from its relaxed state to its actuated state.

As stated above, arrow support arm 130 is vertically movable, in a straight line, between its first position and its second position. This vertical, non-rotational and non-pivotal movement can be accomplished by any number of designs. In a preferred embodiment, shown in FIG. 5, a guide rod 135 is provided to which arrow support arm 130 is movably connected. Extending around guide rod 135 is a biasing means such as a coiled spring 138, which provides downward force against arrow support arm 130. Although one guide rod 135 and spring 138 is illustrated, it is understood that multiple guide rods 135 could be used, if desired, to obtain a more stabile movement of support arm 130. Guide rod 135 can include a low friction coating, such as Teflon, to facilitate the sliding of spring 138 and/or arm 130 over rod 135. Preferably, guide rod 135 and spring 138 are recessed into front arrow support 120, or otherwise protected, in order to minimize any damage that could be caused by the arrow or its fletching, or external objects such as tree branches.

As arrow support arm 130 moves in relation to front arrow support 120 and guide rod 135, support arm 130 remains horizontally fixed; that, the end of support arm 130 at guide rod 135 moves the same distance as the opposite end of support arm 130. Support arm 130 does not pivot or rotate around an end or other portion of arm 130, rather, support arm 130 non-pivotally and non-rotationally moves in a linear manner.

Alternatives to guide rod 135 and spring 138 could be a leaf spring, rubber bands, hydraulics, magnets, a solid linkage attached to cord 140, or any combination that operably connects arrow support arm 130 to cord 140 and that will change the position of support arm 130 when the position of bowstring 40 is changed. Another example would be to attach arrow support arm 130 to a piston that is guided through a cylinder and then operably connected to cord 140.

In the relaxed state, spring 138 urges arrow support arm 130 toward the lower end of guide rod 135. Thus, with no external force provided on arrow rest 100 or on cord 140, arrow support arm 130 is in its relaxed position. In this position, support arm 130 is recessed into front arrow support 120. Although spring 138 is used in the preferred embodiment to move arrow support arm 130 to the relaxed position, it is understood that any biasing means could be used.

Referring again to FIGS. 2 and 3, support structure 110 includes a recess 105 for receiving a dampening system 150. In FIG. 2, dampening system 150 is illustrated removed from support structure 110 and recess 105. During shooting of bow 10, when bowstring 40 is released, a significant vibration is created. In order to enhance performance of bow 10, it is desirous to reduce these vibrations. Dampening system 150 includes a material that is softer than the material that makes up the part of bow handle 25 to which the device is directly attached, such that the dampening system 150 at least partially absorbs the vibrations caused by the release of bowstring 40 when shooting an arrow. In FIGS. 2 and 3, dampening system 150 has two brass cores 152, 154 surrounded by a webbed rubber member 155 positioned around the perimeter of the brass cores 152, 154. It is understood that alternate materials can be used for the components of dampener system 150. For example, cores 152, 154 could be aluminum with an outer perimeter material 155 of plastic. In the embodiment illustrated, recess 105 and dampening system 150 are generally rectangular in shape, with rounded corners. It should be understood that any shape could be used for system 150, such as oval.

Referring to FIG. 6, an arrow A is illustrated from the top supported by arrow rest 100. Arrow rest 100 is mounted on bow handle 25 via support structure 110. Arrow A is centered on arrow support arm 130 and extends across handle ledge 35. Arrow A is further supported by riser 160 which is mounted on, e.g., adhered, to ledge 35. FIG. 4B illustrated the placement of riser 160 on ledge 35. When bowstring 40 is not drawn and arrow support 130 is in its relaxed state, arrow A rests on riser 160. As bowstring 40 is drawn, arrow support arm 130 rises to its actuated state and arrow A lifts off from riser 160. Riser 160 is preferably a soft, cushioning material that cradles arrow A and reduces the sound produced by arrow A contacting ledge 35.

The materials for arrow rest 100 can include metals (e.g., aluminum, steel, brass), plastics (e.g., polycarbonate, acrylics), and ceramics and composite materials. Such materials can be used for any of support structure 110, bracket 115, front arrow structure 120, and arrow support arm 130.

Any or all of these pieces may include a coating thereon. A rubber coating or sleeve on arrow support arm 130 is beneficial for reducing any sound produced when arrow A contacts arrow support arm 130.

The above specification and examples provide a complete description of the manufacture and use of the invention. It is to be understood that other embodiments may be utilized and structural changes may be made without departing from the present invention, including inertia type arrow rests. Since many embodiments of the invention can be made without departing from the spirit and scope of the invention, the invention resides in the claims hereinafter appended.

What is claimed is:

1. An arrow rest for use with a bow, the bow comprising a handle and a bowstring, the arrow rest comprising:

(a) a support structure configured for mounting on the bow handle;

(b) an arrow support arm operably connected to the support structure, the arrow support arm movable in relation to the support structure from a relaxed position to an actuated position in a non-pivotal, non-rotational manner;

(c) a connection means for operably connecting the arrow support arm to the bowstring and for moving the arrow support arm from the relaxed position to the actuated position; and (d) a biasing means for moving the arrow support arm from the actuated position to the relaxed position.

2. The arrow rest according to claim 1, wherein the connection means is a cord.

3. The arrow rest according to claim 1, wherein the biasing means comprises a spring, and the arrow support arm is connected to the spring.

4. The arrow rest according to claim 1, wherein the support structure comprises:

(a) a first support structure configured for mounting on the bow handle; and (b) a second support structure attached to the first support structure, the arrow support arm moveably connected to the second support structure.

5. The arrow rest according to claim 4, wherein the second support structure is moveably attached to the first support structure.

6. The arrow rest according to claim 1, wherein the support structure comprises:

(a) a first support structure configured for mounting on the bow handle;

(b) a bracket attached to the first support structure; and (c) an arrow support structure attached to the bracket, the arrow support arm moveably connected to the arrow support structure.

7. The arrow rest according to claim 6, wherein:

(a) the bracket is laterally movable in relation to the first support structure; and (b) the arrow support structure is vertically movable in relation to the bracket.

8. The arrow rest according to claim 1, further comprising a vibration dampening system.

9. An arrow rest for use with a bow, the bow comprising a handle and a bowstring, the arrow rest comprising:

(a) a support structure for mounting on the bow handle, the support structure comprising a first structure, a second structure, and a third structure, with the third structure laterally and vertically movable in relation to the first structure;

(b) an arrow support arm movable from a relaxed position to an actuated position in a non-pivotal, non-rotational path of motion; and (c) an actuation system operably connecting the arrow support arm to the bowstring for moving the arrow support arm between the relaxed position and the actuated position.

10. The arrow rest according to claim 9, wherein the actuation system comprises a biasing means and a connection means.

11. The arrow rest according to claim 10, wherein the biasing means moves the arrow support arm from the actuated position to the relaxed position and the connection means moves the arrow support arm from the relaxed position to the actuated position.

12. The arrow rest according to claim 11, wherein the biasing means comprises a coiled spring connected to the arrow support arm.

13. The arrow rest according to claim 12, wherein the coiled spring is centrally supported by a guide rod.

14. The arrow rest according to claim 12, wherein the arrow support arm is positioned at a first location on the guide rod when in the relaxed position and at a second location on the guide rod when in the actuated position.

15. The arrow rest according to claim 9, wherein the second structure is laterally movable in relation to the first structure, and the third structure is vertically movable in relation to the second structure.

16. The arrow rest according to claim 9, wherein the third structure comprises a recess to accept the arrow support arm when in the relaxed position.

17. An arrow rest comprising:

(a) a first support structure, a second support structure, and a third support structure, the third support structure laterally and vertically movable in relation to the first support structure;

(b) a guide rod centrally positioned in a coiled spring, the guide rod connected to the third support structure;

(c) an arrow support arm movably connected to the third support structure from a relaxed position to an actuated position along the guide rod; and (d) an actuation system for moving the arrow support arm between the relaxed position and the actuated position, the actuation system comprising the coiled spring.

18. The arrow rest according to claim 17, wherein the second support structure is laterally movable in relation to the first support structure, and the third support structure is vertically movable in relation to the second support structure.

19. The arrow rest according to claim 17, wherein the coiled spring moves the arrow support arm from the actuated position to the relaxed position.

20. The arrow rest according to claim 17, wherein the actuation system further comprises a connection means to move the arrow support arm from the relaxed position to the actuated position.

* * * * *

UNITED STATES PATENT AND TRADEMARK OFFICE

CERTIFICATE OF CORRECTION

PATENT NO. : 6,823,856 B2
DATED : November 30, 2004
INVENTOR(S) : Christopher A. Rager It is certified that error appears in the above-identified patent and that said Letters Patent is hereby corrected as shown below:

Title page,
Item [60], Related U.S. Application Data, delete ", and provisional application No. 60/410,877, filed on Sep. 13, 2002"

Column 1,
Lines 9 and 10, delete "and claim benefit of 60/410,877 filed Sep. 13, 2002"

Column 5,
Line 35, should read -- 7A through 7G --

Signed and Sealed this

Twelfth Day of July, 2005

JON W. DUDAS
*Director of the United States Patent and Trademark Office*